United States Patent [19]

Popp

[11] Patent Number: 4,726,309

[45] Date of Patent: Feb. 23, 1988

[54] SEWING MACHINE WITH DIFFERENTIAL FEED

[75] Inventor: Edmund Popp, Stadelhofen, Fed. Rep. of Germany

[73] Assignee: Pfaff Industriemaschinen GmbH, Fed. Rep. of Germany

[21] Appl. No.: 923,492

[22] Filed: Oct. 27, 1986

[30] Foreign Application Priority Data

Nov. 27, 1985 [DE] Fed. Rep. of Germany ..... 8533380

[51] Int. Cl.[4] ..... D05B 27/06; D05B 27/08; D05B 29/02

[52] U.S. Cl. ..... 112/313; 112/235

[58] Field of Search ..... 112/312, 313, 314, 235, 112/239, 319

[56] References Cited

U.S. PATENT DOCUMENTS

| | | | |
|---|---|---|---|
| 2,705,908 | 6/1956 | Odermann et al. | 112/235 |
| 3,009,432 | 11/1961 | Reeber et al. | 112/235 X |
| 3,665,877 | 5/1972 | Wickers et al. | 112/235 |
| 4,381,722 | 5/1983 | Takeuchi et al. | 112/235 |
| 4,589,364 | 5/1986 | Yamamoto et al. | 112/313 X |

FOREIGN PATENT DOCUMENTS

| | | | |
|---|---|---|---|
| 59-101188 | 6/1984 | Japan | 112/235 |

*Primary Examiner*—Wm. Carter Reynolds
*Attorney, Agent, or Firm*—McGlew and Tuttle

[57] ABSTRACT

A sewing machine with adjustable upper and lower feed dogs is for sewing together sections of clothing in which ungathered segments of seams alternate with seam segments with differing degrees of gather. The spring-held presser foot is coordinated with a pneumatic cylinder as an additional mechanism of increasing contact pressure during the sewing of ungathered segments of seams. The cylinder is operable by a control cam connected to an adjusting mechanism for a stitch guide of one of the feed dogs. When sewing gathered segments, the pressure of the presser foot is greatly reduced, whereas the pressure is increased during the sewing of gathered seam segments and through a "fastening" step at the end of the seam.

6 Claims, 2 Drawing Figures

SEWING MACHINE WITH DIFFERENTIAL FEED

FIELD AND BACKGROUND OF THE INVENTION

The present invention relates in general to sewing machines, and in particular to a new and useful material feed device for sewing machines which includes upper and lower feed dogs, a presser foot, and means for adjusting the movements of the feed dogs and the pressure of the presser foot.

A machine is disclosed in U.S. Pat. No. 3,808,995, that is intended for sewing together sections of clothing in which, in addition to ungathered seam segments, the differential puckering or gathering of an armhole, for example, required to fit a sleeve into a finished article of clothing is also produced in the different segments of the circumference of the sleeve, in other words, ungathered seam segments alternate with seam segments with differing degrees of gather. The differential feed values can be predetermined by corresponding adjustment of the stitch guide for the size of the feed motion of the feed dog. All seam segments are sewn by this sewing machine with the same contact pressure of the presser foot adjusted to an average value based on experiential values.

Although it is known in the trade that with certain types of sewing work the best results can be obtained only with just the right pressure by the presser foot, e.g., gathered sewing must be done at very low pressure, while during ungathered segments a considerable heavier pressure is required, with conventional machines no arrangements have been made to adapt the contact pressure to the given type of sewing operation.

U.S. Pat. No. 2,544,029 does disclose a presser foot control device in which, besides a toggle lever bar operable by the usual toggle lever for reducing the contact pressure and raising the presser foot from the material, a second toggle lever, operable counter to the first toggle lever, is provided on the toggle lever bar by means of which and as needed, when sewing over cross-seams, for example, the angle position of an eccentric supporting the presser bar spring can be changed and the pressure of the presser foot thus be increased and then subsequently reduced again. The alteration and selection of the right contact pressure, however, in each case is left up to the skill and flair of the seamstress, who cannot be expected to find precisely the right adjustment required in each case repeatedly and in alternation. The operating results therefore vary a great deal.

SUMMARY OF THE INVENTION

The object of the present invention is to equip a sewing machine with a differential feed such that first of all, the feed-in of excess material can be executed with reduced contact pressure by the presser foot, the evenness of the gathers being thus improved, such that the material to be gathered is subjected merely to a negligible braking effect by the presser foot, and in the second place, that simultaneously with the adjustment for synchronization of the feed motion of the feed dogs, the contact pressure can be increased for sewing together the sections of clothing without displacement and for gathering and for securely "fastening" the end of the seam.

Accordingly an object of the present invention is to provide a material feed device for a sewing machine which comprises an upper and a lower feed dog, stitch guide means operatively connected to the feed dogs for adjusting their feed motions, adjusting means connected to the stitch guide means for controlling the stitch guide means to change the adjustment of the feed dog motions, a presser foot mounted for engagement against the lower feed dog, first pressure means operatively connected to the presser foot for pressing the presser foot against the lower feed dog, and second pressure means operatively connected to the presser foot and to the adjusting means for exerting additional pressure on the lower feed dog which is dependent on the feed motion of the feed dogs produced by control of the adjusting means.

A further object of the present invention is to form the adjusting means as a control cam which is operatively engageable with an air valve that operates in synchronism with the adjustment of movement for the feed motions, the control cam being rotatable to control the second pressure means.

A still further object of the invention is to mount the control cam at an adjustable angle on the adjusting means, the adjusting means comprising a rotatable disc for one of the feed dogs.

This makes it possible to coordinate precisely the operation of the air valve and the adjustment of the one stitch guide with each other.

A still further object of the invention is to provide a material feed device for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figures 1, 3:
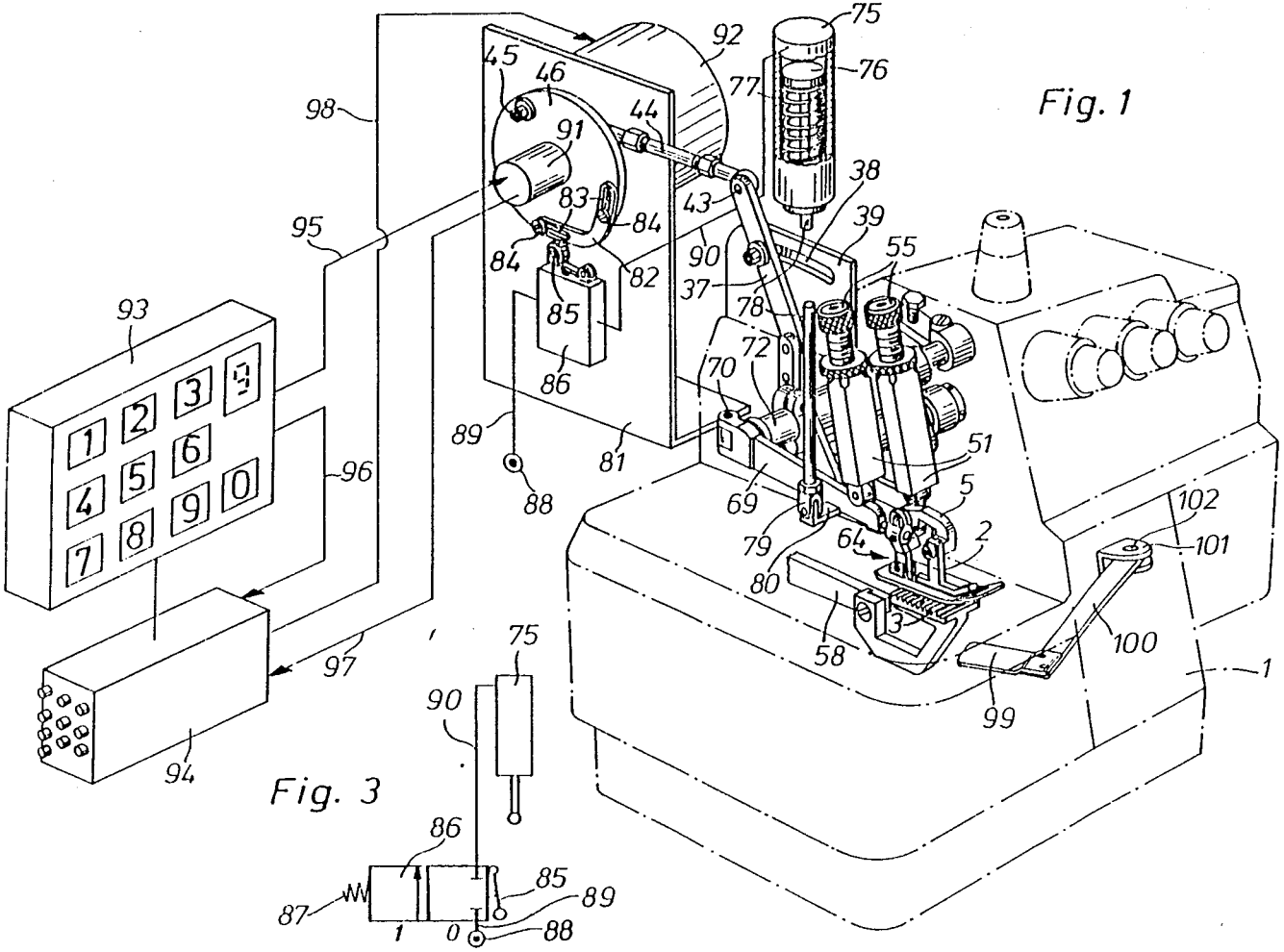
FIG. 1 is a diagrammatic, simplified depiction of a sewing machine with an upper and a lower feed dog, adjustable independently of one another, with a device for controlling one stitch guide and an extra pressure device.
FIG. 3 is a pneumatic switching diagram for the extra pressure device.
Figure 2:
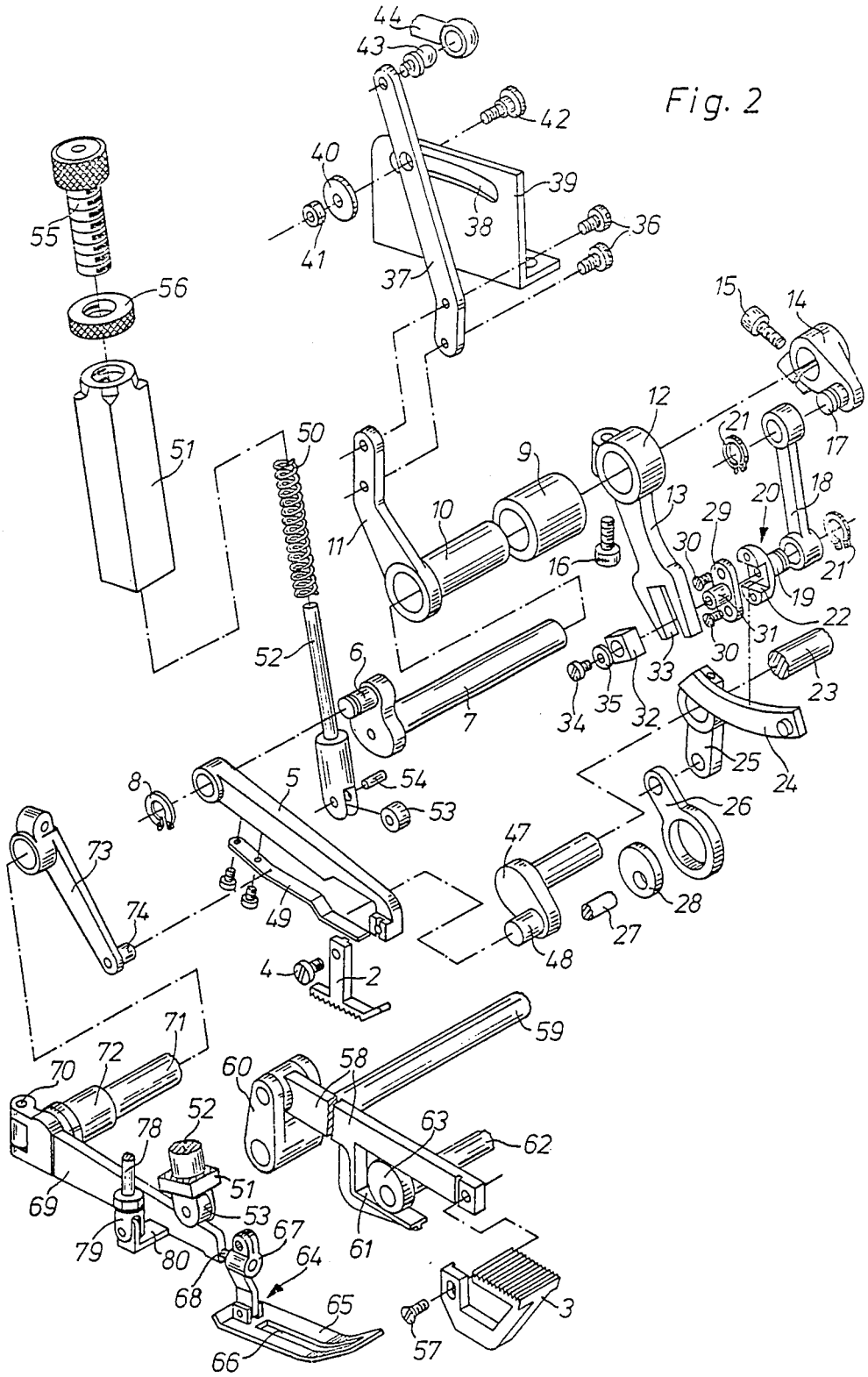
FIG. 2 is a diagrammatic depiction of the feed dog and presser foot mechanism in disassembled condition.

The sewing machine indicated by dash-dotted lines and designated 1 in FIG. 1 is an overcast sewing machine with an upper feed dog 2 and a lower feed dog 3. The lower feed dog 3 is adjustable to an average value of its feed stroke and the upper feed dog 2 is adjustable to a greater need motion by a device to be described below. Referring to FIGS. 1 and 2, the upper feed dog 2 is attached to a support bar 5 by a screw 4. A crank pin 6 of a swing shaft 7 extends through a hole in the opposite end of the support bar 5 of the upper feed dog 2. The connection is secured against axial movement by a spring clip 8.

The swing shaft 7 leads through a hole in a bearing lug 10 projecting from an adjusting level 11 and turnable within a bearing sleeve 9 and a slotted boss 12 on a forked lever 13. A crank 14 is clamped on the end of the swing shaft 7 by a screw 15. The forked lever 13 is clamped on the bearing lug 10 of the adjusting lever 11 by a screw 16. In the crank 14 is mounted a crank pin 17 that is connected by a connecting rod 18 to the link pin 19 of a slide guide 20. The connecting rod 18 is secured against axial movement on the pins 17 and 19 in each case by a spring clip 21.

In a groove 22 in the slide guide 20, a curved guide 24 which is attached to a swing shaft 23, moves. The curved guide 24 has a lever arm 25 that is linked to an eccentric bar 26, whose other end surrounds an eccentric 28 attached to a drive shaft 27.

To shift the slide guide 20 on the curved guide 24 and hence to change the feed motion of the upper feed dog 2, a cover plate 29 is screwed onto the slide guide 20 with screws 30, the cover plate 29 having a bearing pin 31 for a slide block 32 that can move in the guide fork 33 of the fork lever 13 and is secured on the bearing pin 31 by a screw 34 with an intervening washer 35.

As the shaft 27 turns, horizontal feed motions are transmitted to the upper feed dog 2 by this drive connection. Associated with the adjusting bar for the upper feed dog 2 are an extension 37 firmly attached to the adjusting lever 11 by screws 36, onto which extension is screwed a stop screw 42 that passes through a curved slot 38 in a stationary scale plate 39 and secured by a washer 40 and a nut 41, as well as a ball tie rod 44 connected to the free end of the extension 37 via a ball pin 43 and connected to an adjusting disc 46 via a ball pin 45.

In order to transmit the requisite lifting motions to the support bar 5 and hence to the upper feed dog 2, a crank 47 is attached to the oscillating drive shaft 23, a pin 48 being firmly fixed in the free end of the crank 47 and reaching under the support bar 5. In order to dampen noise, the bent free end of a leaf spring 49 screwed to the underside of the support bar lies against the pin 48.

By means of these drive connections, the upper feed dog performs elliptical operating motions.

The support bar 5 with the upper feed dog 2 is pressed downwardly with an adjustable pressure by a compression spring 50. The compression spring 50 is mounted on a presser bar 52 capable of shifting within a housing 51 and having on its lower end a press roller 53 that can turn around a peg 54 and rests on the support bar 5. The compressed length of the compression spring 50 can be changed by means of an adjusting screw 55 that screws into the housing 51 in order to change the force of the spring. The adjusting screw 55 can be locked by means of a knurled nut 56.

The upper feed dog 2 and the lower feed dog 3 work together to move the material by means of a toothed grip. Feed dog 3 is attached by means of a screw 57 to the free end of a support bar 58 that is linked at its other end to a crank 60 attached to a shaft 59 subject to an oscillating drive. By means of this drive connection, horizontal feed motions are transmitted to the support bar 58 and the lower feed dog 3.

An eccentric 63 extends into a forked opening 61 on the support bar 58. Eccentric 63 is attached to a rotating shaft 62, whereby the customary lifting motions are communicated to the support bar 58 and the lower feed dog 3. A combination of the feed and lift motions results in elliptical operating motions of the feed dog 3.

The presser foot 64, whose sole 65 has a slot 66 to allow the upper feed dog 2 to pass through, serves to press the material against the lower feed dog 3. The sole 65 is linked to a shank 67 that grips onto a pin 68 on the presser foot support 69. The presser foot support 69 can pivot around a link pin 70 in a mounting 72 attached to a shaft 71. In addition to the mounting lever 72, a lever 73 is clamped onto the shaft 71, the lever having a pin 74 on its free end that reaches under the support bar 5 of the upper feed dog 2. When the shaft 71 turns, the upper feed dog 2 and the presser foot 64 are raised.

In a fashion similar to that in which the upper feed dog 2 is pressed downwards with an adjustable contact pressure by the pressure device 50 through 56, the presser foot 64 is also acted on by another pressure device, labelled with the same reference numbers for the sake of simplicity.

In addition to this pressure device, the presser foot 64 is provided with an extra pressure device in the form of a single acting pneumatic cylinder 75, whose working piston 76 can be actuated counter to the action of a compression spring 77. The piston rod 78 connected to the working piston 76 bears a fork head 79 that is linked to an angle plate 80 on the presser foot support 69.

To control the pneumatic cylinder 75, a control cam 82 with two screws 84 guided in curved longitudinal slots 83 in the control cam 82 is mounted at an adjustable angle on the adjusting disc 46 turnably mounted on a stationary supporting angle plate 81. When the adjusting disc 46 is in a given angular position, the switching lever 85 of a 2/2-way air valve 86 is activated by the control cam 82. The valve is thus moved oounter to the action of a restoring spring 87 (FIG. 3) from a switching position "0" to a switching position "1", so that the air coming from a pressure source 88 flows through the lines 89 and 90 hooked into this switching position of the valve 86, to the pneumatic cylinder 75, whose working piston 76 and hence the presser foot support 69 via the piston rod 78, the forked head 79 and the angle plate 80 are subjected to additional pressure.

The adjusting disc 46, which is connected to an indicator 91 of the actual angle for the disc, is driven by an electric motor 92 which receives its control order following a request by actuation of the keys of a selection device 93 with a keyboard of a control device 94. The selection device is connected by one line 95 to the actual value indicator 91 and by another line 96 to the control device 94, which is in turn connected by one line 97 to the actual value indicator 91 and by another line 98 with the electric motor 92.

For gathered sewing, a separating plate 99 that can be introduced between the layers of material to be sewn is provided that is mounted on a support arm 100 that is supported on a bearing piece 101 fixed to the sewing machine housing, the arm being capable of pivoting around a link pin 102.

The sewing maching works as follows:

Since the sewing machine is primarily used for gathered sewing, the contact pressure of the presser foot 64 is so far reduced at the adjusting screw 55 for the spring 50 that the upper layer of material to be gathered is subject only to a negligible braking effect by the presser foot 64.

In preparation for the sewing process, the separating plate 99 is pivoted away to the side, the upper feed dog 2 and the presser foot 64 are raised by turning the shaft 71 with the associated presser foot support 69 and the lever 73 whose pin 74 reaches under the support bar 5, the layers of marerial to be sewn are positioned, and the separating plate 99 is pivoted in between the layers of material, when the upper layer of material is supposed to be gathered and then sewn together with the lower layer of material.

The feed motion of the lower feed dog 3 is adjusted for this purpose with the aid of a conventional stitch guide, to a constant median value, in contrast to which the upper feed dog 2 can be adjusted by pressing keys "1" through "9" of the selection device 93 to perform nine increasingly larger feed motions. By these means, adjustments for nine different degrees of gathering are available. By pressing key "0", synchronous adjustment of the feed motions of both feed dogs 2 and 3 is accomplished. This is the case when the layers of material are to be sewn together without gathers. Whichever of the ten available adjustments is selected at any given time is indicated on a lighted display on the selection device 93.

The selected switching pulse of keys "0" through "9", e.g. "9", brings about via the control device 94, a preparatory adjustment of the actual value indicator 91 and the start-up of the electric motor 92, which turns the adjusting disc 46 to an angle corresponding to the selected positon "9". As soon as that angle position is reached, the actual value indicated 91 gives a signal to the control device 94, and the electric motor 92 is shut off.

When the adjusting disc 46 is turned, it also turns, via the ball tie rod 44 and the extension 37, the adjusting lever 11 and with it the bearing lug 10 on which the forked lever 13 is mounted. Via the forked lever 13 and the slide block 32 the slide guide 20 is then moved along the curved guide 24 into a position that corresponds to the feed motion of the upper feed dog 2 requested by pressing key "9". As is state of the art with such sliding stitch guides, the size of the feed motion communicated to the feed dog is dependent on the distance of the slide guide 20 along the curved guide 24 from the shaft 23 on which curved guide 24 driven by the rotating shaft 27 by means of the eccentric 28 via the eccentric rod 26 in an oscillating drive is mounted.

Now that the sewing machine 1 has been switched on, the swinging motion communicated by the curved guide 24 is transmitted via the link pin 19 of the slide guide 20, the connecting rod 18 and the crank pin 17 to the crank 14 and hence to the swinging shaft 7. The motion is then transmitted as horizontal feed motions via the crank pin 6 to the support bar 5 and hence to the upper feed dog 2. The size of those motions, as already said, is greater than the mean value of the feed motions communicated to the lower feed dog 3 by the swing shaft 59 via the crank 60 of its support bar 58, so that a given excess of the upper layer of material is moved forward and a given degree of gather is thus created.

In addition to the feed motions, the requisite lift motions are communicated to the lower feed dog 3 by the eccentric 63 on the shaft 62 and to the upper feed dog 2 via the crank 47 on the swing shaft 23 and the pin 48 that reaches under the support bar 5.

The degree of gather in the upper layer of material can be changed at any time the machine is at rest by pressing one of keys "1" through "9" on the selection device 93. The slide guide 20 is then shifted by the electric motor 92 via the adjusting disc 46 as described above into another position on the curved guide 24, whereupon the size of the feed motion communicated to the upper feed dog 2 is changed.

Since all gathered sewing is performed with very low pressure by the presser foot 64, the amount of excess material called for can be more precisely controlled, and the gathers come out more even.

In order to sew together the layers of material without shifting gathering during certain seam segments, for which purpose much stronger pressure by the presser foot 64 is required, and the separating plate 99 is pivoted out to the side, the ungathered segments being usually marked when the material is cut out, as are the gathered segments as well, the synchronous adjustment of the feed motions of both feed dogs 2 and 3 is started by pressing the "0" key on the selection device 93. The adjusting disc 46 is thereupon turned by the electric motor 92 so that in the requisite adjustment of the slide guide 20 along the curved guide 24 the control cam 92 on the adjusting disc 46 presses down the switching lever 85 of the air valve and the air valve 86 thereupon moves from the locked-void position "0" to the flow-through switching position "1". In the flow-through switching position "1" the working piston 76 of the pneumatic cylinder 75 is subjected via lines 89 and 90 to pressurized air. This has the effect that the presser foot 64 is pressed downwardly with extra pressing force via the piston rod 74 acting on the presser foot support 69. By increasing the pressure acting on the presser foot, shifting of the layers of material with respect to one another is effectively prevented, and empty stitching when the material passes out of the stitching location is better controlled.

While a specific embodiment of the invention has been shown and described in detail to illustrate the application of the principles of the invention, it will be understood that the invention may be embodied otherwise without departing from such principles.

What is claimed is:

1. A material feed device for a sewing machine, comprising a lower feed dog for executing feed movements, an upper feed dog for executing feed movements, stitch guide means connected to at least one of said upper and lower feed dogs for adjusting feed movements thereof, adjusting means operatively connected to said stitch guide means for controlling said stitch guide means to adjust the feed movements of said at least one of said upper and lower feed dogs, a presser foot, first pressure means operatively connected to said presser foot for urging said presser foot against said lower feed dog under an adjustable pressure, and second pressure means operatively connected to said presser foot and operatively connected to said adjusting means for applying additional pressure to said presser foot which depends on the adjustment of the feed motion of said at least one of said upper and lower feed dogs which is controlled by said adjusting means.

2. A device according to claim 1 wherein said adjusting means includes a pneumatic valve and a control cam movably mounted against said pneumatic valve for actuating said pneumatic valve, said second pressure means being connected to said pneumatic valve for receiving pressurized air therefrom to apply the additional pressure to said presser foot.

3. A device according to claim 2 wherein said adjusting means comprises a disc mounted for rotation, said control cam being connected to said disc, said pneumatic valve being mounted at a fixed location with respect to said disc.

4. A device according to claim 1 wherein said adjusting means comprises a rotatably mounted disc, a control cam mounted in an adjustable position on said disc and operatively engageable with said second pressure means for actuating said second pressure means to apply the additional pressure to said presser foot, and means for rotating said disc, said disc being operatively connected to said stitch guide means for adjusting the feed movements of said at least one of said upper and lower feed dogs.

5. A material feed device for use in a sewing machine to form gathered and ungathered seams, comprising:

an upper feed dog;

a lower feed dog;

stitch guide means connected to said upper feed dog for adjusting a feed movement of said upper feed dog;

drive means connected to said lower feed dog for driving said lower feed dog to execute feed movements;

adjusting means operatively connected to said stitch guide means for controlling said stitch guide means to adjust the feed motion of said upper feed dog;

a presser foot mounted for movement against said lower feed dog;

first adjustable pressure means operatively connected to said presser foot for applying a first adjustable pressure against said lower feed dog; and second adjustable pressure means operatively connected to said presser foot and to said adjusting means for applying additional pressure to said presser foot and against said lower feed dog as a function of the controlled adjustment of feed motion by said adjusting means on said stitch guide means.

6. A device according to claim 5 wherein said adjusting means comprises a rotatably mounted disc, a control cam mounted on said disc at an adjustable position and an air valve mounted at a fixed location with respect to said disc and engageable by said control cam to actuate said air valve, said second pressure means comprising a pneumatic cylinder and piston combination connected to said air valve and operatively connected to said presser foot for receiving pressurized air from said air valve and for applying additional pressure to said presser foot.

* * * * *